US008300407B2

(12) United States Patent
Zhang

(10) Patent No.: US 8,300,407 B2
(45) Date of Patent: Oct. 30, 2012

(54) DRAWER AND ELECTRONIC DEVICE USING THE SAME

(75) Inventor: Shuai Zhang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 233 days.

(21) Appl. No.: 12/819,397

(22) Filed: Jun. 21, 2010

(65) Prior Publication Data

US 2011/0187252 A1 Aug. 4, 2011

(30) Foreign Application Priority Data

Feb. 1, 2010 (CN) ..... 2010 1 0301009

(51) Int. Cl.
*G06F 1/16* (2006.01)
*H05K 7/16* (2006.01)
*A47B 47/00* (2006.01)

(52) U.S. Cl. ..... 361/679.55; 361/679.58; 361/726; 361/727; 361/679.39; 312/293.1; 312/293.2; 312/293.3

(58) Field of Classification Search ..... 361/679.01–679.45, 679.55–679.59, 361/724–727; 312/293.1–293.3, 333, 223.1, 312/223.2; 211/26
See application file for complete search history.

(56) References Cited

U.S. PATENT DOCUMENTS

| | | | | |
|---|---|---|---|---|
| 5,229,919 | A * | 7/1993 | Chen | 361/679.31 |
| 5,563,767 | A * | 10/1996 | Chen | 361/679.31 |
| 5,586,003 | A * | 12/1996 | Schmitt et al. | 361/679.58 |
| 5,682,291 | A * | 10/1997 | Jeffries et al. | 361/679.58 |
| 6,442,019 | B1 * | 8/2002 | Lim | 361/679.4 |
| 6,619,770 | B1 * | 9/2003 | Drab et al. | 312/333 |
| 6,891,720 | B2 * | 5/2005 | Voon et al. | 361/679.31 |

* cited by examiner

*Primary Examiner* — Jayprakash N Gandhi
*Assistant Examiner* — Nidhi Desai
(74) *Attorney, Agent, or Firm* — Altis Law Group, Inc.

(57) ABSTRACT

A drawer received in an electronic device includes a drawer assembly, two locking assemblies, and a drawer cover. The drawer assembly is for carrying a component of the electronic device, and is operable to move in and out of the electronic device via an opening of the electronic device. The two locking assemblies are fixed on the electronic device. The opening is located between the two locking assemblies. The drawer cover is rotatable connected to the two locking assemblies, and is for covering the opening to block the drawer assembly from inadvertently being detached out of the electronic device.

13 Claims, 8 Drawing Sheets

DRAWER AND ELECTRONIC DEVICE USING THE SAME

BACKGROUND

1. Technical Field

The present disclosure relates to electronic devices, and particularly to an electronic device with a drawer.

2. Description of Related Art

A hard disk drive (HDD) is an important component of a computer. For protecting the HDD, the HDD is always installed inside a host computer. As such, if the HDD needs to be replaced or repaired, the host must be disassembled, which is inconvenient.

Therefore, there is room for improvement in the art.

BRIEF DESCRIPTION OF THE DRAWINGS

The components of the drawings are not necessarily drawn to scale, the emphasis instead being placed upon clearly illustrating the principles of the embodiment of an electronic device with a drawer. Moreover, in the drawings, like reference numerals designate corresponding parts throughout several views.

DETAILED DESCRIPTION

Embodiments of the present disclosure will now be described in detail with reference to the drawings.

Figure 1:
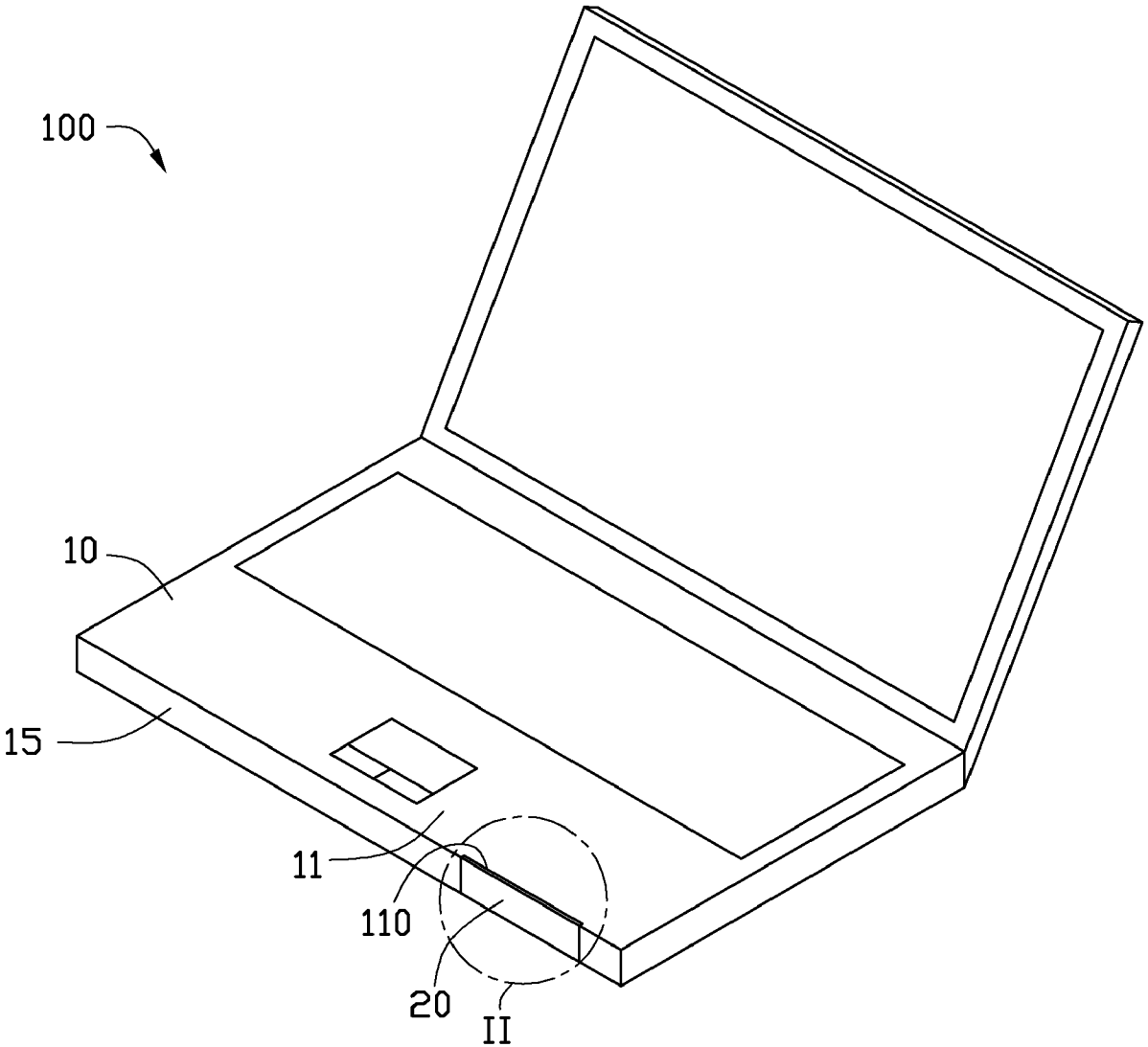
FIG. 1 is an isometric, schematic view of an electronic device according to an exemplary embodiment.
Figure 2:
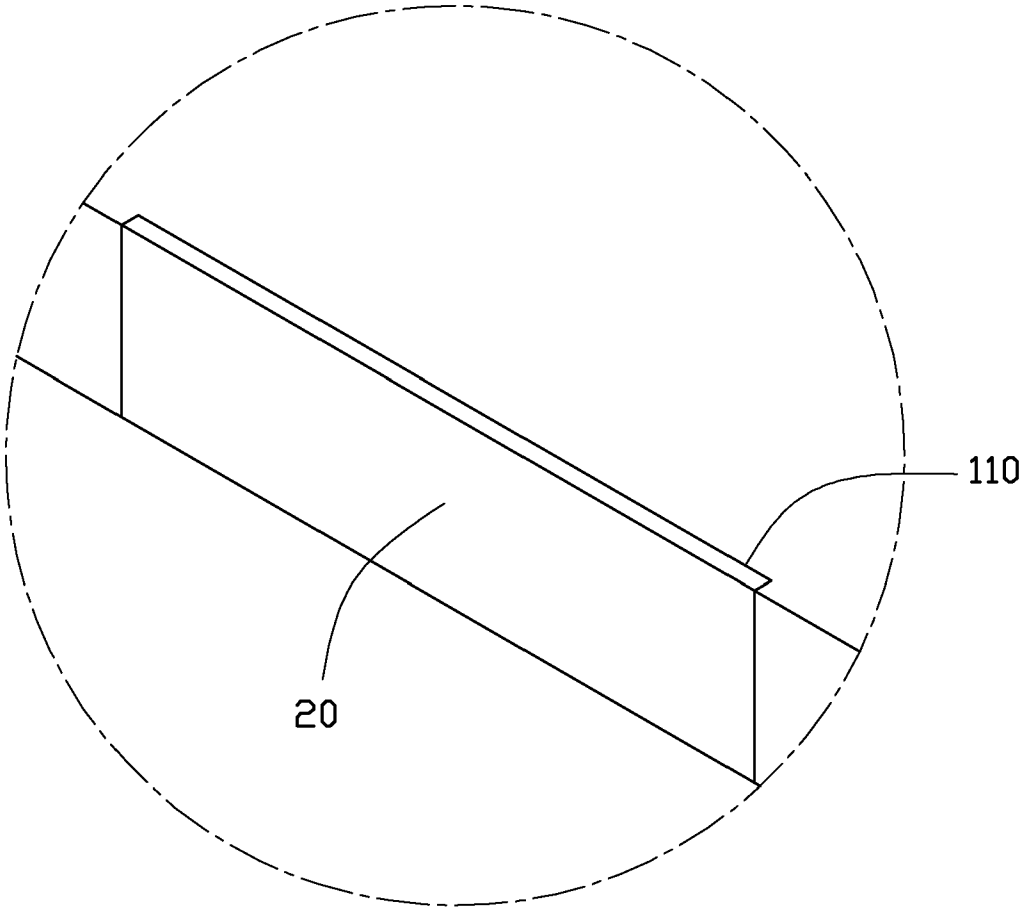
FIG. 2 is an enlarged view of a circled portion II of FIG. 1.
Figure 3:
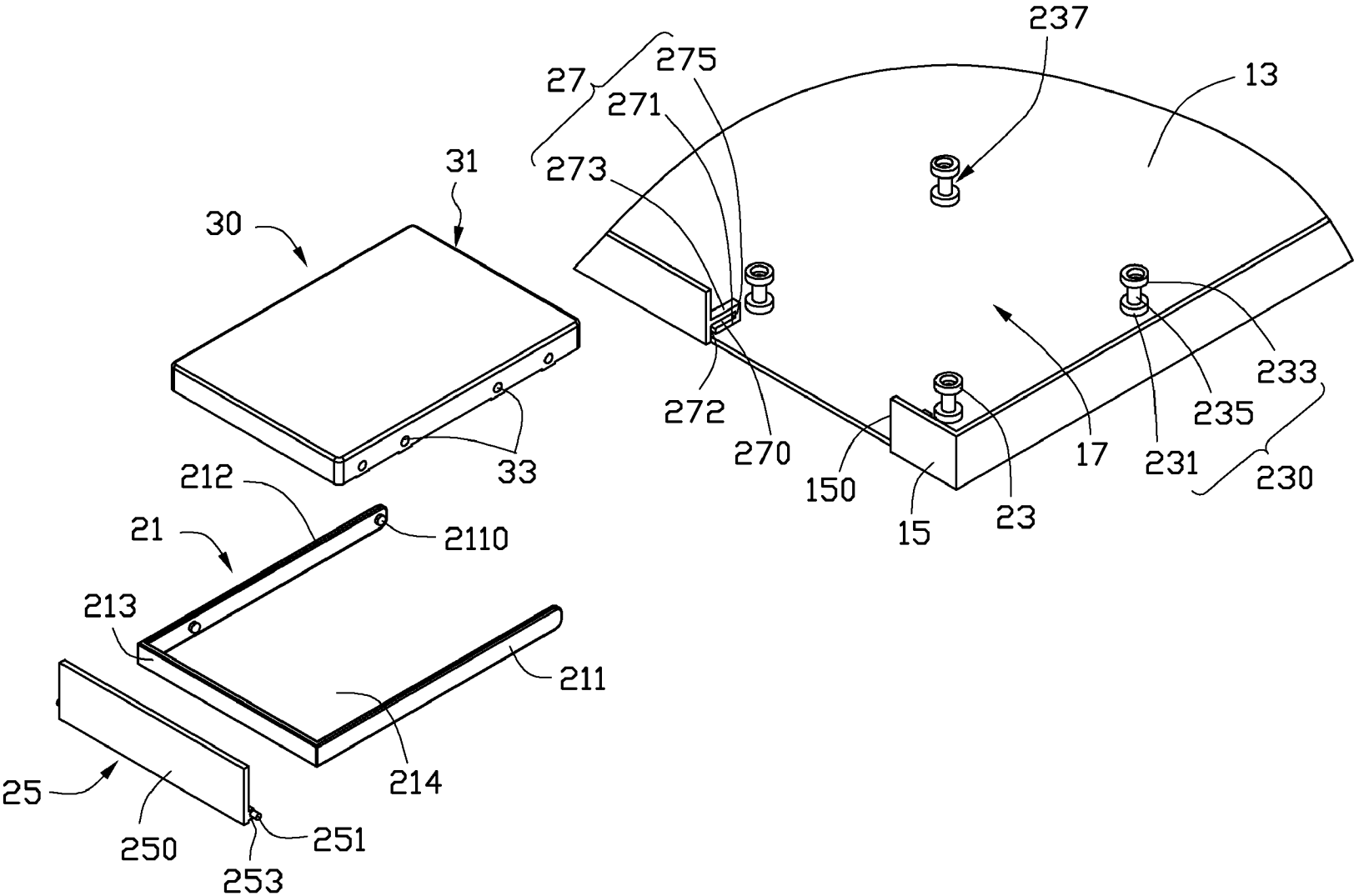
FIG. 3 is a partially exploded view of the electronic device of FIG. 1.

Referring to FIGS. 1, 2, and 3, an electronic device 100 according to an exemplary embodiment is illustrated. The electronic device 100 includes a housing 10, a drawer 20 received in the housing 10, and a component 30 carried by the drawer 20. In this embodiment, the component 30 is a hard disk drive (HDD), and the electronic device 100 is a notebook computer. In other embodiments, the component 30 can be a battery, a CD/DVD drive, or other components, and the electronic device 100 can be a desktop computer, a DVD player, or other electronic devices.

The component 30 includes an interface portion 31. The interface portion 31 is used for electrically connecting the component 30 to a circuit board (not shown) of the electronic device 100. A plurality of limiting holes 33 is defined on opposite sides of the component 30 next to the interface portion 31.

The housing 10 includes a top wall 11, a bottom wall 13 parallel to the top wall 11, and a side wall 15 connecting the top wall 11 to the bottom wall 13. The top wall 11, the bottom wall 13, and the side wall 15 cooperate to define a receiving room 17. The top wall 11 defines a first opening 110. The side wall 15 defines a second opening 150 communicating with the first opening 110. The two openings 110 and 150 are used for receiving the drawer 20 to move in or out of the housing 10.

The drawer 20 includes a drawer assembly 21, a guiding assembly 23, a drawer cover 25, and two locking assemblies 27.

The drawer assembly 21 is substantially U-shaped and received in the receiving room 17. The drawer assembly 21 is used for carrying the component 30. The drawer assembly 21 is operable to move in and out of the housing 10 via the two openings 110 and 150. The drawer assembly 21 includes a first flange 211, a second flange 212 substantially parallel to the first flange 211, and a third flange 213. One end of the third flange 213 is connected to the first flange 211, and the other end of the third flange 213 is connected to the second flange 212.

The three flanges 211, 212, and 213 cooperate to define a receiving space 214. The receiving space 214 is used for receiving the component 30. A plurality of limiting poles 2110 is set on inner sides of the first flange 211 and the second flange 212. The limiting poles 2110 correspond to the limiting holes 33 of the component 30. By the limiting poles 2110 inserted into the corresponding limiting holes 33, the drawer assembly 21 transports the component 30. When the component 30 is carried, the interface portion 31 is away from the third flange 213, and electrically connects with the circuit board of the electronic device 100. The third flange 213 is received in the two openings 110 and 150, and allows convenient manipulation by users for moving the drawer assembly 21 in and out of the receiving room 17.

In other embodiments, the drawer assembly 21 can be other structures as long as the drawer assembly 21 can carry the component 30. For example, the assembly 21 can further include a bottom plate perpendicularly connected to the three flanges 211, 212, and 213. The receiving space 214, used for receiving the component 30, is defined in the bottom plate, the three flanges 211, 212, and 213.

The guiding assembly 23 is used for supporting the drawer assembly 21 and guiding the drawer assembly 21 to slide in and out of the receiving room 17. The guiding assembly 23 includes four guiding members 230. Each guiding member 230 includes a first fixing portion 231, a second fixing portion 233 substantially parallel to the first fixing portion 231, and a connecting portion 235 connecting the two fixing portions 231 and 233 and configured to define a guiding groove 237.

The first fixing portion 231 is set on the bottom wall 13 and faces the top wall 11. The guiding groove 237 is used for receiving one of the two flanges 211 and 212. As the guiding assembly 23 has four guiding members 230, four guiding grooves 237 are defined accordingly. Two of the four guiding grooves 237 receive the first flange 211, and the other two grooves 237 receive the second flange 212. Thus, the drawer assembly 21 is carried by the guiding assembly 23 and slides in the four grooves 237 and against the connecting portion 235. In this embodiment, the two fixing portions 231 and 233, and the connecting portion 235 are cylindrical. The cylindrical connecting portion 235 gives a low friction force to the sliding drawer assembly 21. In other embodiments, the two fixing portions 231 and 233 can be other shapes, such as plate-shaped.

In the embodiment, screws can be engaged with the guiding assembly 23 and the bottom wall 13, thus, the guiding assembly 23 is fixed on the bottom wall 13. The guiding assembly 23 can be fixed on the bottom wall 13 by means of any suitable adhesive.

In other embodiments, the number of the guiding members 230 can be more than four, and the guiding assembly 23 can be another structure as long as the guiding assembly 23 can guide the drawer assembly 21 to slide in and out of the receiving room 17. For example, the guiding assembly 23 can have two opposite grooves, one of the two grooves receives the fixing flange 211, and the other one receives the second flange 212.

Figure 4:
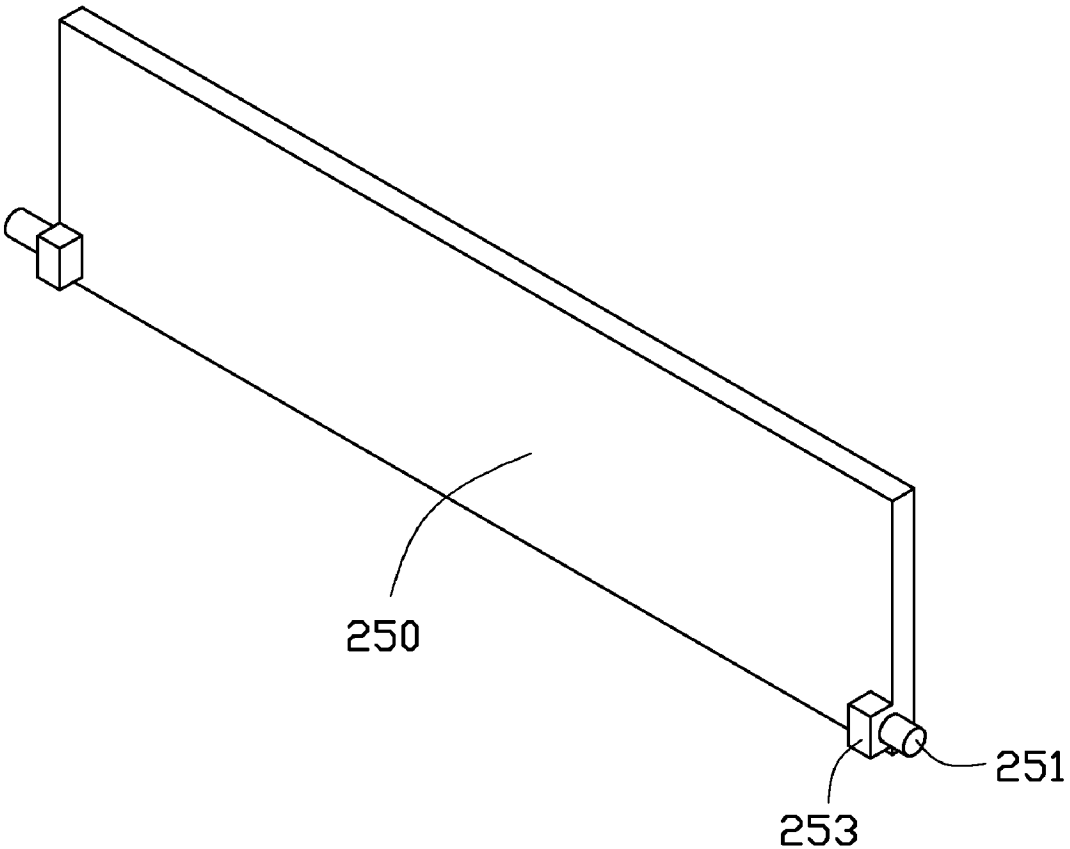
FIG. 4 is a partially, enlarged view of the electronic device of FIG. 3.

Referring to FIGS. 3 and 4, to keep the drawer assembly 21 from disengaging out of the receiving room 17, the drawer cover 25 covers the second opening 150. Two fixing members 253 perpendicularly extend from opposite ends of the same side of the drawer cover 25. Two dowels 251 extend from each fixing members 253. The longitudinal axis of the two dowels 251 are substantially parallel to the plane of the drawer cover 25. The two dowels 251 are operable to act as shafts of the drawer cover 25.

The two locking assemblies 27 are extending from inner side of the casing 15 and are corresponding to the two dowels 251. The second opening 150 is defined between the two locking assemblies 27. The two dowels 251 are rotatablely inserted in the two locking assemblies 27. Thus, the drawer cover 25 can be rotated out of the second opening 150.

Figure 5:
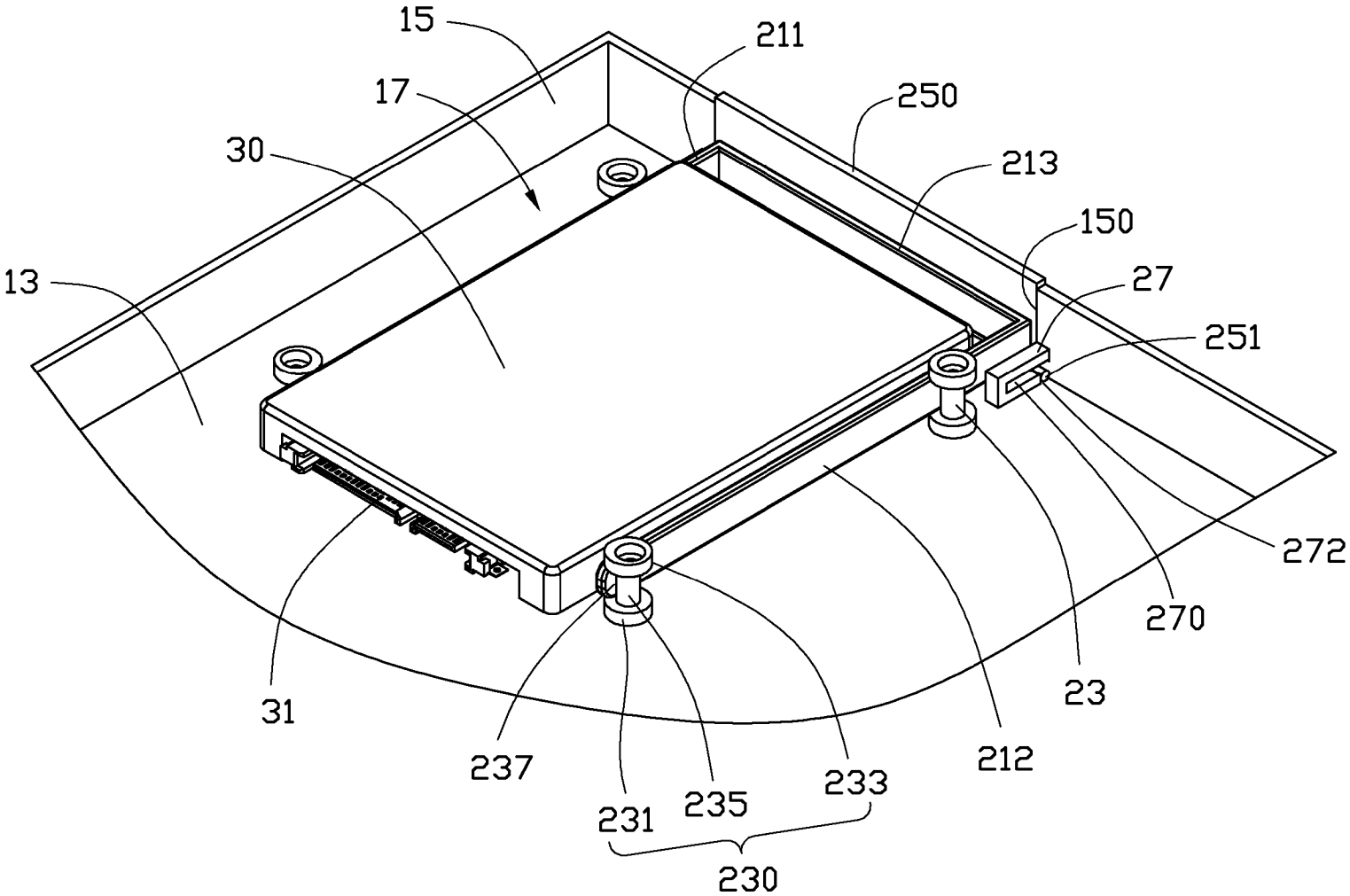
FIG. 5 is a partially, schematic view of the electronic device of FIG. 1 in a first state.

Referring to FIGS. 3 and 5, each locking assembly 27 is substantially U-shaped, and includes a first clamping member 271, a second clamping member 273, and a connecting member 275 connecting the two clamping members 271 and 273. One end of the second clamping member 273 is connected to the side wall 15. The other end of the second clamping member 273 is connected to one end of the connecting member 275. The other end of the connecting member 275 is connected to the first clamping member 271, the other end of the first clamping member 271 is free and keeps a distance from the side wall 15 to define a channel 272. The first clamping member 271, the second clamping member 273, and the connecting member 275 define a sliding groove 270. The sliding groove 270 is used for guiding the corresponding dowel 251 to slide. The two dowels 251 are operable to freely move in and out of the corresponding sliding grooves 270 via the corresponding channels 272.

Figure 6:
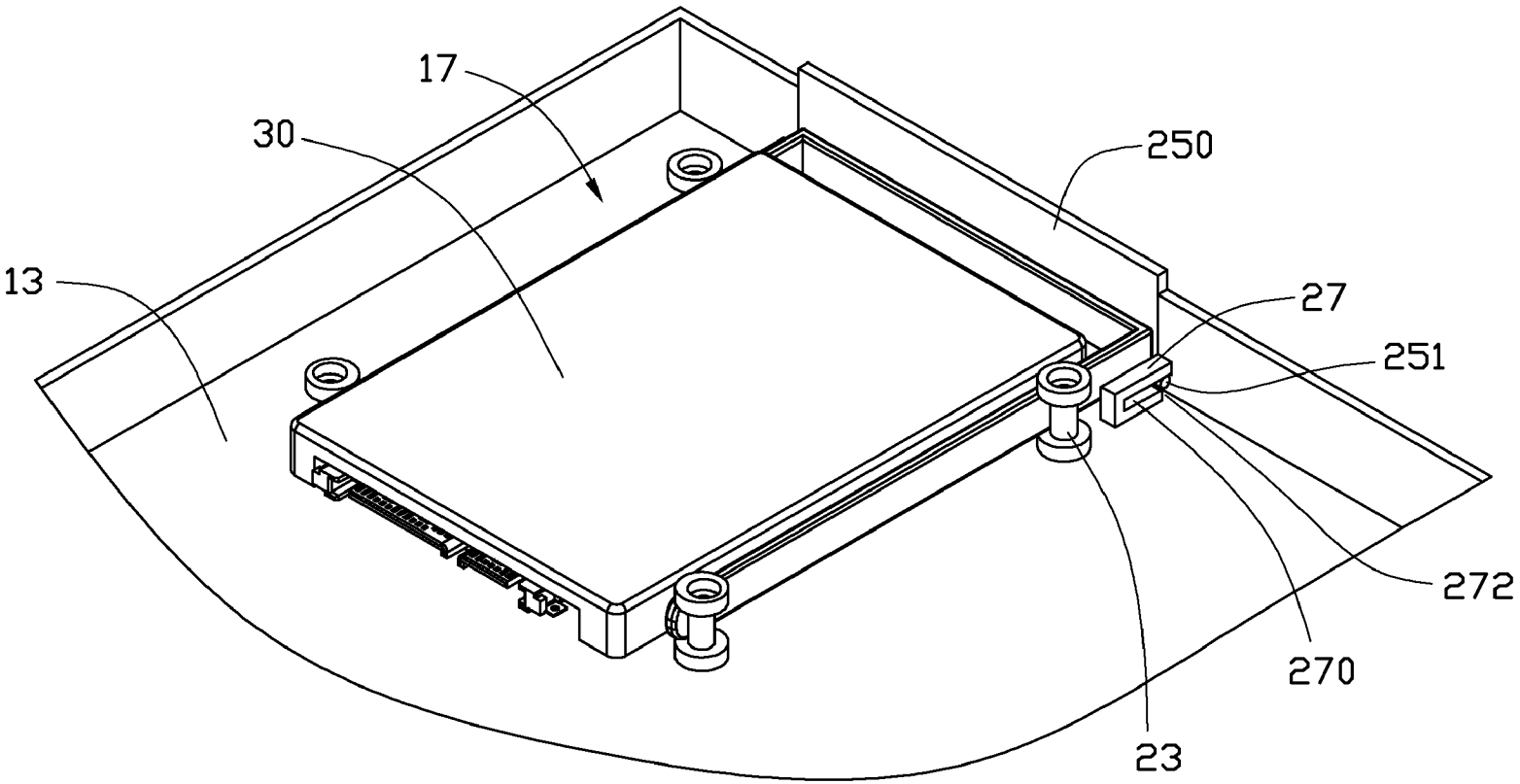
FIG. 6 is similar to FIG. 5, but showing the electronic device in a second state.
Figure 7:
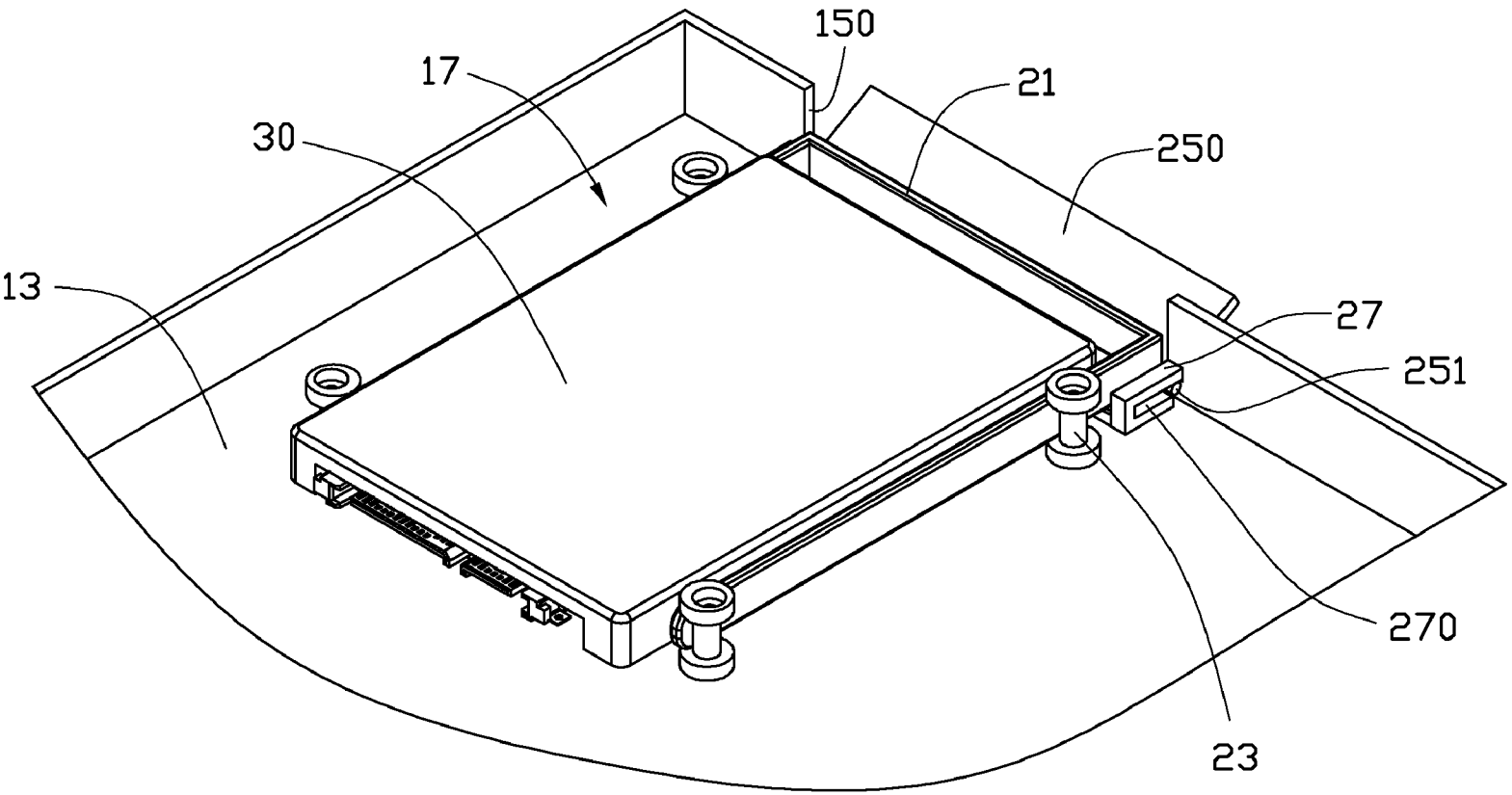
FIG. 7 is similar to FIG. 5, but showing the electronic device in a third state.
Figure 8:
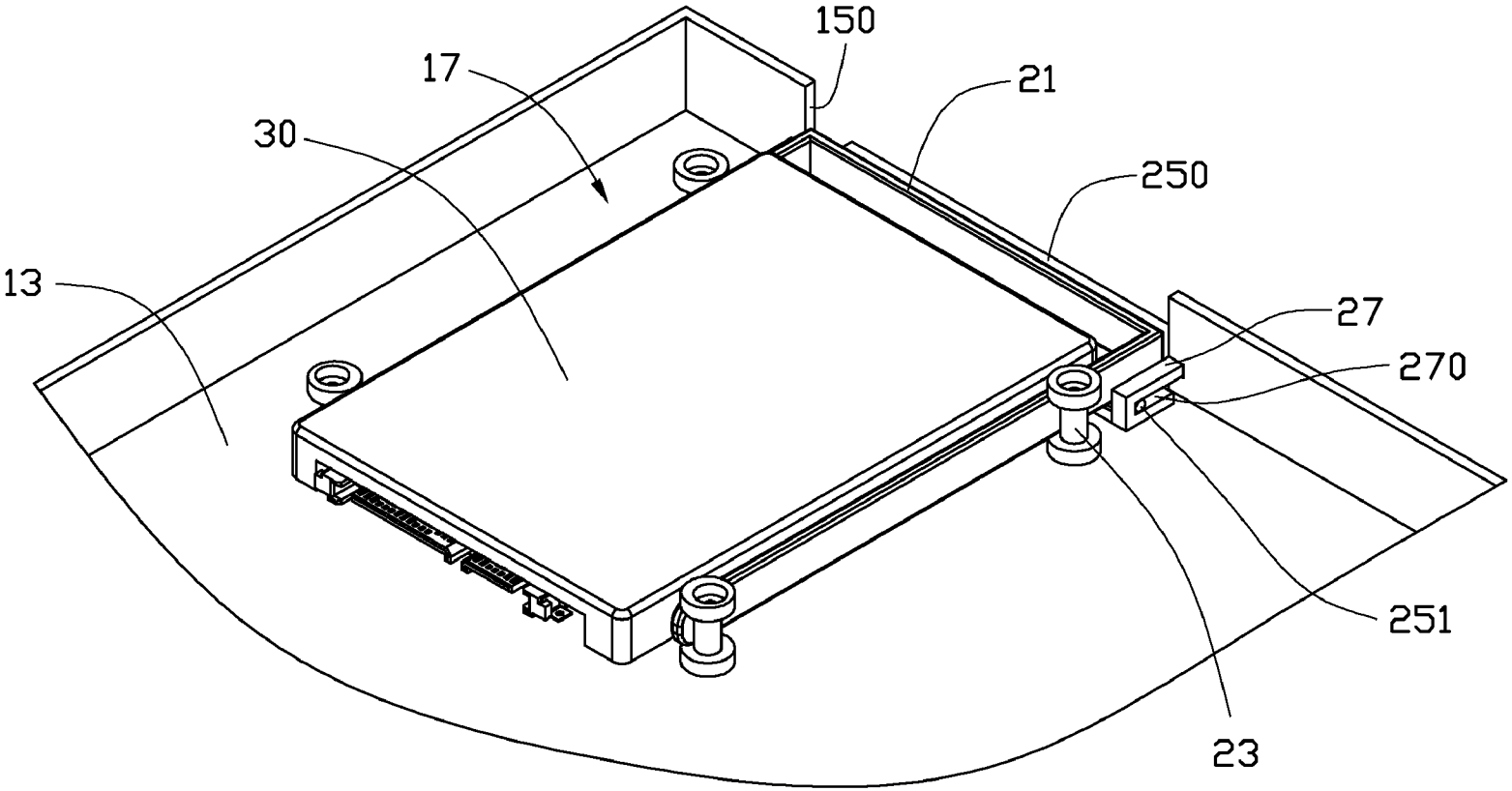
FIG. 8 is similar to FIG. 5, but showing the electronic device in a fourth state.

When the drawer cover 25 is received in the second opening 150, the two dowels 251 are received in the corresponding channels 272 (as a first state see FIG. 5). When the drawer cover 25 is rotated out of the first opening 110, the two dowels 251 are moved in the corresponding sliding grooves 270 from the corresponding channels 272 (as a second state see FIG. 6). When the drawer cover 25 is rotated out of the second opening 150, the drawer assembly 21 is operable to slide in and out of the receiving room 17 by the guiding of the guiding assembly 23 (as a third state see FIG. 7). The component 30 can be removed from the drawer assembly 21. When the drawer cover 25 is pushed into the receiving room 17 along the sliding grooves 270, the drawer cover 25 is received in the receiving room 17 (as a fourth state see FIG. 8). Thus, it is easy for users to replace or repair the component 30. Accordingly, the drawer cover 25 is operable to be pushed into the receiving room 17 by the guiding of the sliding grooves 270 when the component 30 has been replaced or repaired, and placed in the drawer assembly 21.

While various exemplary and preferred embodiments have been described, it is to be understood that the disclosure is not limited thereto. To the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A drawer received in an electronic device, the drawer comprising:

a drawer assembly for carrying a component of the electronic device, the drawer assembly operable to move in and out of the electronic device via an opening of the electronic device;

two locking assemblies fixed on the electronic device, the opening located between the two locking assemblies, each locking assembly comprising a first clamping member, a second clamping member and a connecting member connecting the first clamping member and the second clamping member to define a sliding groove, a first end of the second clamping member being directly connected to the electronic device, a second end of the second clamping member being connected to a first end of the connecting member, a second end of the connecting member being connected to a first end of the first clamping member, a second end of the first clamping member being free and keeping a distance from the electronic device to define a channel; and a drawer cover rotatable connected to the two locking assemblies, two dowels being set on opposite ends of a same side of the drawer cover, the two dowels being operable to freely move in and out of the corresponding sliding grooves via the corresponding channels, resulting in that the drawer cover covers the opening to block the drawer assembly from inadvertently being detached out of the electronic device, or rotates out of the opening.

2. The drawer of claim 1, wherein the drawer assembly comprises a first flange, a second flange parallel to the first flange, and a third flange perpendicularly connecting opposite ends of the first flange and the second flange, the first flange, the second flange, and the third flange define a receiving space for carrying the component.

3. The drawer of claim 2, wherein a plurality of limiting poles is set on opposite sides of the first flange and the second flange, a plurality of limiting holes corresponding to the limiting poles is defined on opposite sides of the component, the component is carried by the receiving space via the plurality of limiting poles inset into the corresponding limiting holes.

4. The drawer of claim 2, further comprising a guiding assembly for supporting the drawer assembly and guiding the drawer assembly to slide in and out of the electronic device.

5. The drawer of claim 4, wherein the guiding assembly comprises a plurality of guiding members, each guiding member comprises a first fixing portion, a second fixing portion parallel to the first fixing portion, and a connecting portion connecting the first fixing portion and the second fixing portion to define a guiding groove, the plurality of guiding grooves is for receiving the first flange and the second flange to guide the drawer assembly to slide.

6. The drawer of claim 1, wherein when the drawer cover is perpendicularly pulled to protrude out of the opening, the two dowels are received in the corresponding sliding grooves via the corresponding channels.

7. The drawer of claim 1, wherein when the drawer cover is rotated out of the opening, the drawer assembly is operable to slide in and out of the electronic device.

8. The drawer of claim 1, wherein when the drawer cover is pushed into the electronic device along the sliding grooves, the drawer cover is operable to be received in the electronic device.

9. An electronic device, comprising:

a housing defining an opening;

a drawer assembly received in the housing, the drawer assembly operable to move in and out of the housing via the opening;

a component carried by the drawer assembly;

two locking assemblies fixed on the housing, the opening located between the two locking assemblies, each locking assembly comprising a first clamping member, a second clamping member and a connecting member connecting the first clamping member and the second clamping member to define a sliding groove, a first end of the second clamping member being directly connected to the electronic device, a second end of the second clamping member being connected to a first end of the connecting member, a second end of the connecting member being connected to a first end of the first clamping member, a second end of the first clamping member being free and keeping a distance from the electronic device to define a channel; and a drawer cover rotatable connected to the two locking assemblies, two dowels being set on opposite ends of the same side of the drawer cover, the two dowels being operable to freely move in and out of the corresponding sliding grooves via the corresponding channels, resulting in that the drawer cover covers the opening to block the drawer assembly from inadvertently being detached out of the housing, or rotates out of the opening.

10. The electronic device of claim 9, wherein the housing comprises a top wall, a bottom wall, and a side wall connected the top wall and the bottom wall, a receiving room is corporately defined by the top wall, the bottom wall, and the side wall, the receiving room is for receiving the drawer assembly, the component, two locking assemblies, and the drawer cover, the opening is defined by the top wall and the side wall.

11. The electronic device of claim 10, further comprising a guiding assembly for supporting the drawer assembly and guiding the drawer assembly to slide in and out of the housing.

12. The electronic device of claim 9, wherein when the drawer cover is rotated out of the opening, the drawer assembly is operable to slide in and out of the housing under the guiding of the guiding assembly.

13. The electronic device of claim 9, when the drawer cover is pushed into the housing along the sliding grooves, the drawer cover is operable to be received in the electronic device.

* * * * *